US006109887A

United States Patent [19]

Takura et al.

[11] Patent Number: 6,109,887

[45] Date of Patent: Aug. 29, 2000

[54] ELECTRIC PUMP

[75] Inventors: Toshiyasu Takura, Hino; Yoshifumi Tanabe, Shizuoka-ken, both of Japan

[73] Assignee: Toshiba Tec Kabushiki Kaisha, Tokyo, Japan

[21] Appl. No.: 09/033,339

[22] Filed: Mar. 2, 1998

[30] Foreign Application Priority Data

Mar. 5, 1997 [JP] Japan ..... 9-050176

[51] Int. Cl.[7] ..... F04B 17/00; F04B 35/00

[52] U.S. Cl. ..... 417/348; 417/410.1; 417/423.7

[58] Field of Search ..... 417/348, 349, 417/350, 351, 352, 353, 410.1, 420, 423.1, 423.3, 423.7

[56] References Cited

U.S. PATENT DOCUMENTS 4,382,199 5/1983 Isaacson .
5,205,721 4/1993 Isaacson .
5,527,159 6/1996 Bozeman, Jr. et al. ..... 417/45
5,652,493 7/1997 Hendershot, Jr. ..... 318/701

FOREIGN PATENT DOCUMENTS 52-79302 7/1977 Japan .
59-89544 5/1984 Japan .
5-180191 7/1993 Japan .

*Primary Examiner*—Teresa Walberg
*Assistant Examiner*—Thor S. Campbell
*Attorney, Agent, or Firm*—Frishauf, Holtz, Goodman, Langer & Chic, P.C.

[57] ABSTRACT

An electric pump of the present invention includes a stator assembly having an annular transverse section, and a rotor assembly rotatably supported in a center hole of the stator assembly and selectively rotating in a desired direction in cooperation with the stator assembly. At least a portion of an outer peripheral surface of the rotor assembly is formed into a shape of a blade for an axial-flow pump.

15 Claims, 5 Drawing Sheets

ELECTRIC PUMP

BACKGROUND OF THE INVENTION

The present invention relates to an electric pump, and more particularly, to an electric pump formed integrally with an electric motor.

An electric pump of this kind is known from, e.g., Jpn. Pat. Appln. KOKAI Publication No. 52-79302. In the conventional electric pump described in this publication, a stator assembly of a motor is water-tightly held in a casing having a circular cross section, and a double center shaft supporting a rotor assembly for the motor and an impeller for a pump is disposed inside of the stator assembly in a center hole of the casing. The double center shaft includes an outer cylindrical portion and an inner solid shaft portion. The rotor assembly corresponding to the stator assembly in its radial direction is fixed to an outer peripheral surface of the outer cylindrical portion, and opposite ends of the inner solid shaft portion are projected from opposite ends of the stator assembly in its longitudinal direction. The opposite ends of the inner solid shaft portion are rotatably supported by a pair of bearings supported in the center hole of the casing. The impeller for the pump is fixed to one of the ends of the inner solid shaft portion between one of the bearings supporting said one end of the inner solid shaft portion and one of the ends of the stator assembly corresponding to said one end of the inner solid shaft portion. One end of the outer cylindrical portion corresponding to said one end of the inner solid shaft portion is enlarged in its radial direction along the impeller between the impeller and said one end of the stator assembly facing the impeller. The other end of the outer cylindrical portion is fixed to the other end of the inner solid shaft portion, and has a plurality of through-holes passing through the outer cylindrical portion from its outer peripheral surface to its inner peripheral surface.

In the conventional electric pump constituted as described above, a fluid is introduced into the center hole of the casing from a side of the other end of the double center shaft, and is further introduced, through the plurality of through-holes in the other end of the outer cylindrical portion of the double center shaft, into the center hole of the outer cylindrical portion. The fluid in the center hole of the outer cylindrical portion is guided to the impeller along the inner solid shaft portion, and then, is thrown out radially outwardly between the impeller and said one end of the outer cylindrical portion by the impeller. The fluid thrown out from the impeller collides against the inner peripheral surface of the casing, and then, is discharged into outside of the center hole of the casing from a side of said one end of the double center shaft.

The conventional electric pump constituted as described above has the following drawbacks: That is, since the impeller for the pump and the combination of the rotor assembly and the stator assembly for the motor are disposed adjacent in the longitudinal direction of the double center shaft, a size of the conventional electric pump in the longitudinal direction is increased; The double center shaft has a large size in its radial direction, and increases the size of the conventional electric pump in its radial direction; And, the double center shaft of a complicated structure which is independently formed and independently assembled, a combination of the rotor assembly and the stator assembly for the motor which are independently formed and independently assembled, and the impeller for the pump which is independently formed and independently assembled, all complicate the manufacture and the assembly of the conventional electric pump, and increases the manufacturing costs thereof.

The present invention is derived from the above circumstances, and an object of this invention is to provide a new electric pump which can decrease sizes in its longitudinal and radial directions of the rotor assembly, and which is simple in its structure and can easily be manufactured and assembled so that its manufacturing cost can be lowered.

BRIEF SUMMARY OF THE INVENTION

To achieve the above object of the invention, an electric pump according to the present invention comprises: a stator assembly having an annular transverse section; and a rotor assembly rotatably supported in a center hole of the stator assembly and selectively rotating in a desired direction in cooperation with the stator assembly, at least a portion of an outer peripheral surface of the rotor assembly having formed into a shape of a blade for an axial-flow pump.

In the electric pump according to the present invention characterized as constituted in the above-described manner, since at least a portion of the outer peripheral surface of the rotor assembly which is rotatably supported in the center hole of the stator assembly is formed into a shape of the impeller for the axial-flow pump, it is unnecessary to produce an impeller for the pump independently of the combination of the rotor assembly and the stator assembly for the motor, and it is also unnecessary to form the center shaft for the rotor assembly into a double structure. Therefore, according to the electric pump of the present invention, it is possible to reduce the sizes in both the longitudinal and radial directions of the rotor assembly, and the structure is simple, manufacture and assembling are easy, and the manufacturing costs can be lowered.

In the electric pump according to the present invention characterized as constituted in the above-described manner, it is preferable that side surfaces of a plurality of recesses extending between opposite end surfaces of the rotor assembly in a direction along a rotational center line of the rotor assembly at a plurality of positions separated from each other in a circumferential direction of the outer peripheral surface of the rotor assembly function as blades for the axial-flow pump.

It is easy to form such a plurality of recesses.

In the electric pump according to the present invention characterized as constituted in the above-described manner, it is preferable that the rotor assembly includes a rotor having a plurality of core pieces stacked along the rotational center line of the rotor assembly, each of the plurality of core pieces has a plurality of recesses each recessed radially inwardly at a plurality of positions separated from each other in a circumferential direction on an outer edge of each core piece, and side surfaces of the plurality of recesses function as blades for the axial-flow pump by offsetting the plurality of core pieces in the circumferential direction while the plurality of core pieces are stacked in the longitudinal direction.

It is easy to form the blades for the axial-flow pump by stacking and offsetting a plurality of core pieces, and makes degrees of freedom in shape high.

In the electric pump according to the present invention characterized as constituted in the above-described manner, the rotor assembly may include a magnet magnetized in a radial direction of the rotor assembly.

In the electric pump according to the present invention characterized as constituted in the above-described manner, the rotor assembly can further include a plurality of rotors separated from each other along the rotational center line of the rotor assembly, at least a portion of an outer peripheral surface of each of the rotors being formed into a blade for the axial-flow pump.

In this case, it is preferable that a magnet magnetized in a direction along the rotational center line is disposed between the adjacent two rotors. The magnet disposed in this manner can enlarge a volume of a flow path created between the remaining portion of the outer peripheral surface of the rotor assembly and the inner peripheral surface of the central hole of the stator assembly while the diameter of each of the rotor assembly is reduced, and makes a magnetic flex density in each of the rotors large to make a rotation torque produced by the rotor assembly large. And, the magnet reduces centrifugal force generated therein, and can provide an electric pump which not only have a small size and a light weight but also have a large discharge.

In the electric pump according to the present invention characterized as constituted in the above-described manner, the rotor assembly may include a rotor having an I-shaped or cross-shaped transverse section perpendicular to the rotational center line of the rotor assembly, or may include a rotor formed into a transverse cross section having three or more than five radially projecting portions.

In the electric pump according to the present invention characterized as constituted in the above-described manner, the electric pump may further comprise a fluid guide device previously rotating a fluid in a rotational direction of the rotor assembly before the fluid is introduced into the rotor assembly.

Such a fluid guide device improves a suction volumetric efficiency of the rotor assembly as an impeller for the axial-flow pump.

In the electric pump according to the present invention characterized as constituted in the above-described manner, the electric pump may further comprise a fluid guide device guiding a fluid immediately after the fluid is discharged from the rotor assembly, from in the rotational direction of the rotor assembly to in the direction along the rotational center line thereof.

Such a fluid guide device improves a fluid discharging efficiency of the rotor assembly as the impeller for the axial-flow pump.

In the electric pump according to the present invention characterized as constituted in the above-described manner, the electric pump may further comprise a rotor blade rotating with the rotor assembly and forcedly supplying a fluid toward the rotor assembly before the fluid is introduced into the rotor assembly.

Such a fluid forcedly supplying rotor blade improves the suction volumetric efficiency of the rotor assembly as the impeller for the axial-flow pump.

In the electric pump according to the present invention characterized as constituted in the above-described manner, the electric pump may further comprise a rotor blade rotating with the rotor assembly and forcedly discharging a fluid from the rotor assembly immediately after the fluid is discharged from the rotor assembly.

Such a fluid forcedly discharging rotor blade improves the fluid discharging efficiency of the rotor assembly as the impeller for the axial-flow pump.

In the electric pump according to the present invention characterized as constituted in the above-described manner, the electric pump may further comprise a waterproof layer which covers the outer peripheral surface of the stator assembly, and may further comprise a waterproof layer which covers the outer peripheral surface of the rotor assembly.

In the electric pump according to the present invention characterized as constituted in the above-described manner, the electric pump may further comprise a waterproof layer which covers the outer peripheral surface of the rotor assembly, and the waterproof layer may be formed to have a shape of a vane of the impeller for the axial-flow pump.

Such a waterproof layer is a synthetic resin of an organic material such as polyethylene or an inorganic material such as ceramic.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Various embodiments and a modification of the present invention will be described in detail with reference to the accompanying drawings attached below.

First Embodiment

At first, referring to FIGS. 1 to 4F, a first embodiment of the present invention will be described in detail.

Figure 1:
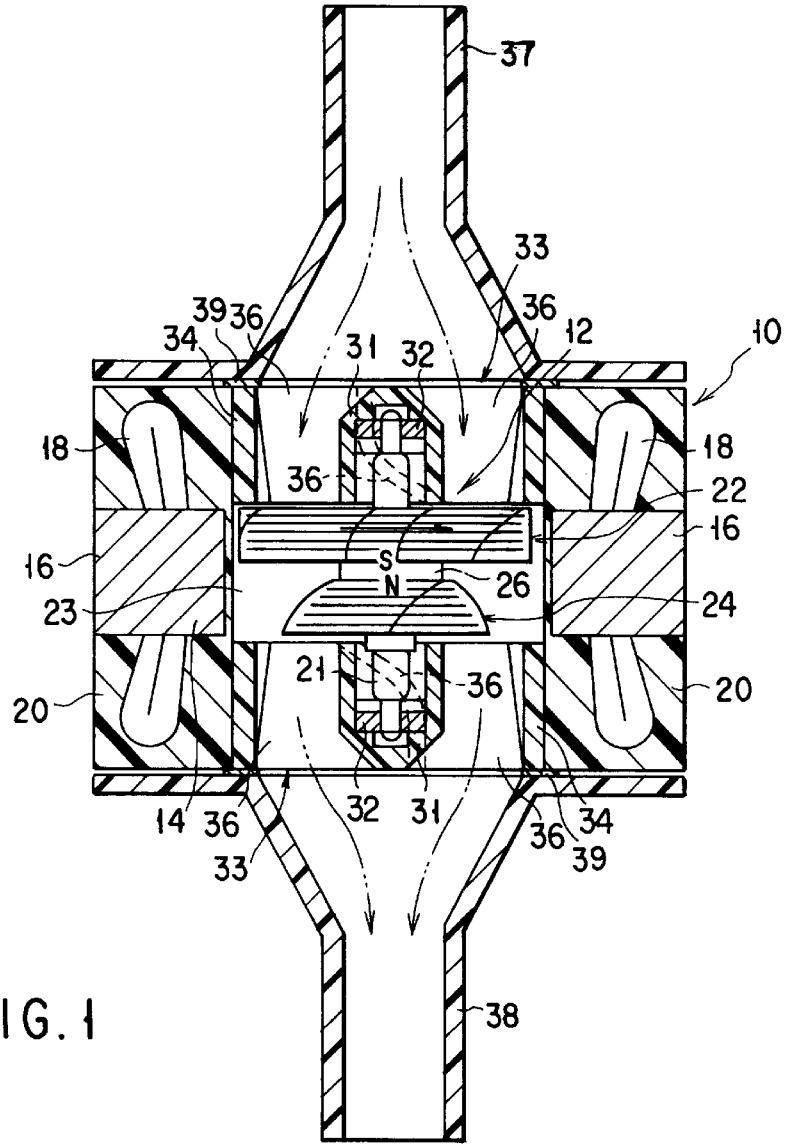
FIG. 1 is a schematic longitudinal sectional view of an electric pump according to a first embodiment of the present invention.

As shown in FIG. 1, an electric pump according to the first embodiment of the present invention includes a stator assembly 10 having an annular transverse section, and a rotor assembly 12 disposed in a center hole of the stator assembly 10.

The stator assembly 10 includes a stator core 16 of an annular transverse section having a plurality of projecting lines 14 each projecting radially inwardly and extending along a rotational center line of the rotor assembly 12, a plurality of exciting winding wires 18 wound on the projecting lines 14 of the stator assembly 10, and a water-proof insulating layer 20 covering the outer peripheral surface of the stator core 16, together with the plurality of the exciting winding wires 18, and being shaped to have a cylindrical configuration. The waterproof insulating layer 20 may be a synthetic resin of an organic material, for example polyester.

More specifically, as shown in FIGS. 4A to 4F, the stator core 16 of the present embodiment is constituted by stacking a plurality of core plates each having a substantially flat circular ring shape, and each core plate has six projections projecting radially inwardly from six positions separated equidistantly from each other on the circular ring. The stacked six inward projections of the plurality of core plates constitute six projecting lines 14 of the stator core 16. In FIGS. 4A to 4F, the exciting winding wires 18 (FIG. 1) wound around the six projecting lines 14 of the stator core 16 are omitted to clarify these figures. The six exciting winding wires 18 are connected with Y- or Δ-wire connection and expose three lead wires (not shown) outside of the insulating layer 20. Three-phase alternating current in which phases are shifted from 120° from each other is supplied to the three lead wires (not shown). When three-phase alternating current is supplied to the six exciting winding wires 18, if opposed one pair of the exciting winding wires 18 is called as a phase-I, and another opposed one pair of the exciting winding wires 18 adjacent the phase-I is called as a phase-II, and the remaining opposed one pair of the exciting winding wires 18 adjacent the phase-II is called as a phase-III, the six exciting winding wires 18 are excited in the order of the phase-I, the phase-II and the phase-III in a counterclockwise direction in FIGS. 4A to 4F. By changing the frequency of the three-phase alternating current, the speed of the sequential excitation of the six exciting winding wires 18 in the order of the phase-I, the phase-II and the phase-III is changed. The above described combination of the stator core 16 and the plurality of the exciting winding wires 18 is well known in the conventional induction motor and in the conventional synchronous motor.

Figure 2A:
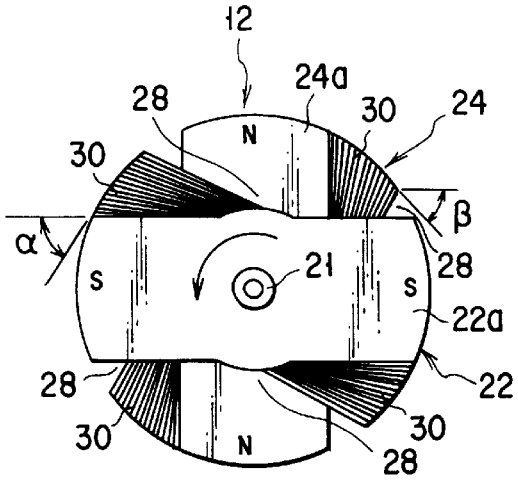
FIG. 2A is a schematic front view of a rotor assembly of the electric pump shown in FIG. 1.
Figure 2B:
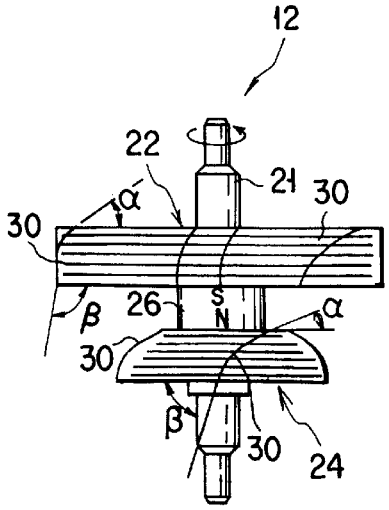
FIG. 2B is a schematic bottom view of the rotor assembly shown in FIG. 2A.

As shown in FIGS. 1, 2A and 2B, the rotor assembly 12 includes a center shaft 21 coaxially arranged in the center hole of the stator assembly 10, two rotors 22 and 24 fixed concentrically on the center shaft 21 so that the two rotors 22 and 24 are separated from each other in a direction along the center line of the center hole within a space region 23 corresponding to the stator core 16 in the center hole of the stator assembly 12, and a cylindrical magnet 26 concentrically interposed between the two rotors 22 and 24 on the center shaft 21. The cylindrical magnet 26 is magnetized in a direction along the center line.

In the present embodiment, as clearly shown in FIG. 2A, each of the rotors 22 and 24 is constituted by stacking a plurality of core pieces 22*a* or 24*a* each having a substantially I-shape in a transverse section perpendicular to the center shaft 21, and further by offsetting the plurality of core pieces 22*a* or 24*a* in a predetermined circumferential direction on the center shaft 21. One rotor 24 is arranged to the other rotor 22 such as to intersect thereto at substantially right angles on the center shaft 21.

A substantially half-circular shaped space, located along each of both side surfaces 30 of each of the two rotors 22 and 24 between diametrically opposite ends of each of the two rotors 22 and 24 and encircled by a rotation locus of the outer peripheral surfaces of the opposite ends of each of the rotors 22 and 24, constitutes a recess 28. The both side surfaces 30 which face the recess 28 at each of the opposite ends of each of the two rotors 22 and 24 are so shaped that they function as blades for an axial-flow pump when each of the rotor 22 and 24 is rotated.

The outer peripheral surfaces of the two rotors 22 and 24 and the outer peripheral surface of the magnet 26 are covered integrally with a waterproof layer. The waterproof layer can not be seen in FIGS. 1, 2A and 2B because the layer is so thin that it is integral with these outer peripheral surfaces. Such a waterproof layer can be constituted by adhering a synthetic resin of an organic material such as polyethylene or by adhering an inorganic material such as ceramic.

Depending on a thickness of the waterproof layer, small gaps produced on the both side surfaces 30 of each of the opposite ends of each of the two rotors 22 and 24 by the stacking and shifting of the plurality of core pieces 22*a* or 24*a* are buried under the layer so that the both side surfaces 30 have smooth appearance.

Opposite ends of the center shaft 21 which is common to the two rotors 22 and 24 are projected outward in opposite directions from the stator core corresponding space region 23 in the center hole of the stator assembly 10, and are concentrically rotatably supported in the center hole by a pair of bearing devices 32 which are supported through a pair of bearing supporting members 31 at the opposite outward regions in the center hole. In the present embodiment, each of the bearing devices 32 is constituted by a sleeve bearing made of synthetic resin or ceramic.

Figure 3A:
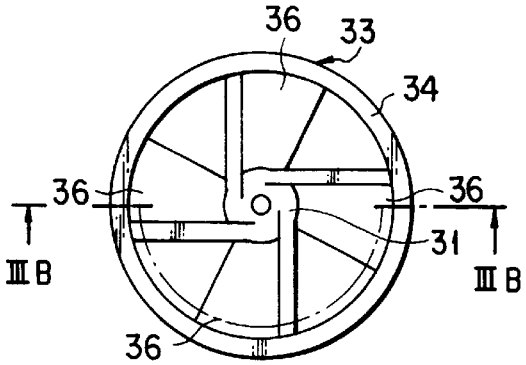
FIG. 3A is a schematic front view of one of two fluid guide devices used in combination with two rotors of the rotor assembly in the electric pump in FIG. 1.
Figure 3B:
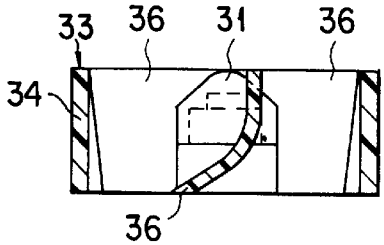
FIG. 3B is a schematic longitudinal sectional view of the fluid guide device shown in FIG. 3A.

As shown in FIGS. 1, 3A and 3B, the bearing supporting members 31 are held at the center of the center hole by a pair of fluid guide devices 33 disposed on inner peripheral surfaces of the opposite outward regions in the center hole of the stator assembly 10.

In the present embodiment, the fluid guide device 33 includes a plurality of fluid guide vanes 36 extending toward the center of the center hole from a cylindrical member 34 fitted to each of the inner peripheral surfaces of the opposite outward regions in the center hole of the stator assembly 10, and the inner ends of the plurality of fluid guide vanes 36 hold the bearing supporting member 31 as described above. An angle of each of the plurality of fluid guide vanes 36 to the center shaft 21 is gradually increased while it approaches from a position away from the rotor 22 or 24 corresponding to the guide vanes 36 toward the corresponding rotor 22 or 24, so that the angle becomes the same as an inclined angle (inlet angle α or outlet angle β) of the opposite side surfaces 30 of each of the opposite ends of the corresponding rotor 22 or 24 at the opposite edges of the side surfaces 30 in the direction along the center shaft 21.

The inlet angle a and the outlet angle β are well known in the blade of the axial-flow pump. These angles are independently set such that the rotors 22 and 24 can obtain maximum flow rate at their predetermined rotational speed.

Each of these fluid guide devices 33 constituted as described above functions to increase a fluid suction efficiency or a fluid discharge efficiency of each of the rotors 22 or 24 corresponding to each fluid guide device 33.

Fluid guide tubes 37 and 38 for guiding the introduction of the fluid into the center hole of the stator assembly 10 and for guiding the discharge of the fluid from the stator assembly 10 are attached to the opposite end surfaces of the stator assembly 10 located in the direction along the center shaft 21 through seal members 39. More specifically, in the present embodiment, since each of the fluid guide tubes 37 and 38 is made of thermoplastic synthetic resin, the fluid guide tubes 37 and 38 are welded to the opposite end surfaces of the stator assembly 10 while the tubes 37 and 38 press the seal members 39 on the opposite end surfaces.

Figure 4A:
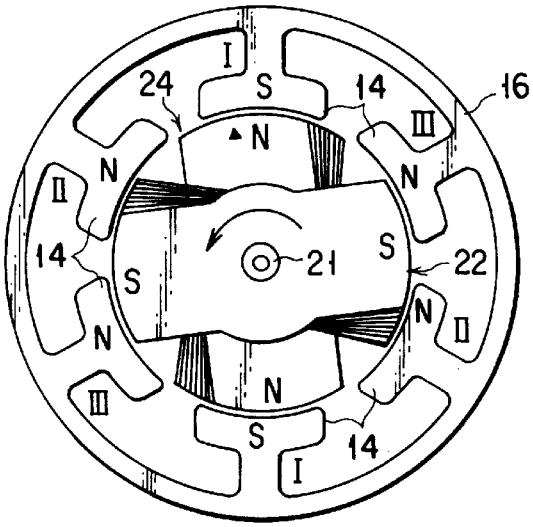
FIGS. 4A, 4B, 4C, 4D, 4E and 4F are schematic front views sequentially showing states for one rotation of the rotor assembly with respective to the stator assembly by interaction between the stator assembly and the rotor assembly of the electric pump shown in FIG. 1.
Figure 4B:
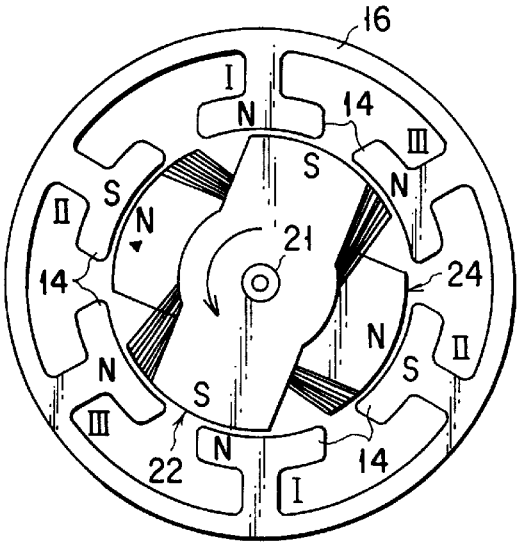
Figure 4C:
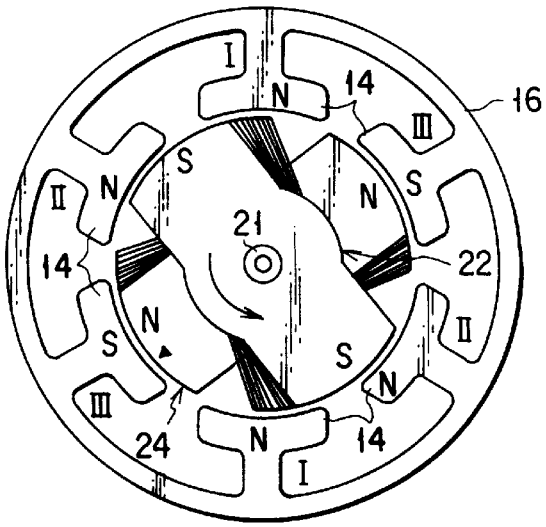

In the electric pump according to the first embodiment according to the present invention as constituted in the above-described manner, when electric current is sequentially supplied to the pair of projection lines 14 of the phase-I, the pair of projection lines 14 of the phase-II and the pair of projection lines 14 of the phase-III of the stator core 16, inner ends of the pair of projection lines 14 of each of the phase-I, phase-II and phase-III are sequentially magnetized as the south magnetic pole as shown in FIGS. 4A to 4C. One rotor 24 of the rotor assembly 12 whose opposed ends are magnetized as the north magnetic pole is attracted by the sequential magnetization of the three pairs of the projection lines 14 of the stator core 16 with the S-magnetic pole, and is rotated, together with the rotor 22, through a half turn in the counterclockwise direction in FIGS. 4A to 4C. In each of these Figures, in order to clearly show the rotation of the rotor 24, an arrow is added around the rotational center shaft 21 to show a rotational direction of the rotor 24, and a black triangular mark is added on one of the opposite ends of the rotor 24 magnetized as the north magnetic pole.

Figure 4D:
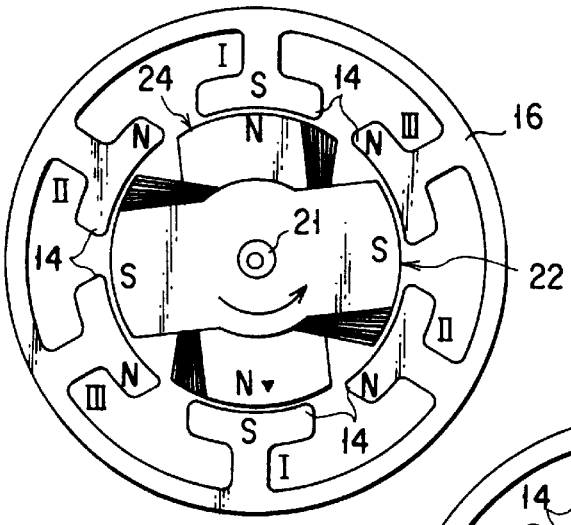
Figure 4E:
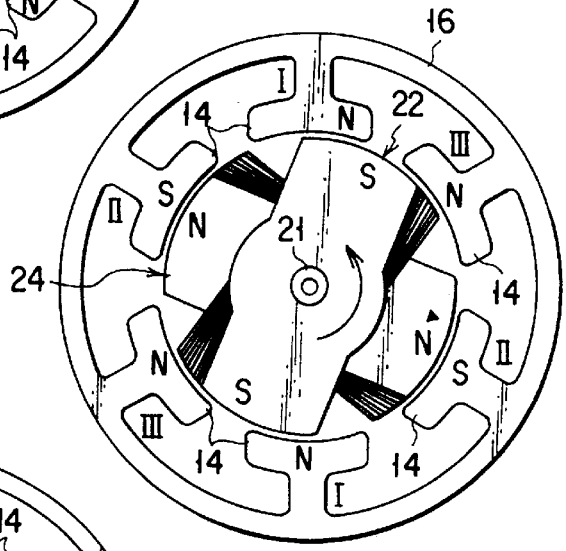
Figure 4F:
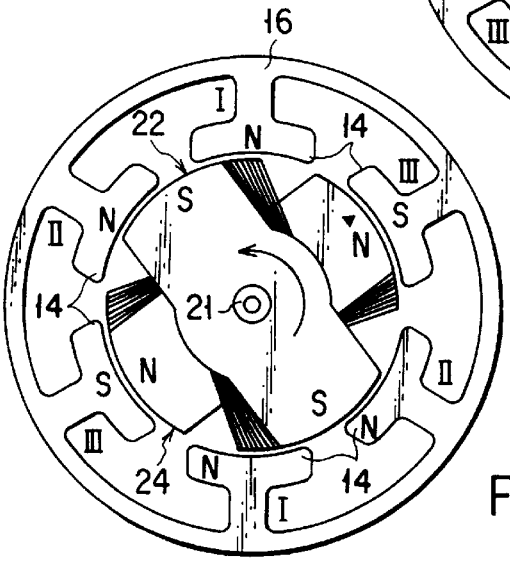

After the above-described half rotation, when further electric current is sequentially supplied to the pair of projection lines 14 of the phase-I, the pair of projection lines 14 of the phase-II and the pair of projection lines 14 of the phase-III of the stator core 16, the inner ends of the pair of projection lines 14 of each of the phase-I, the phase-II and the phase-III are sequentially magnetized as the south magnetic pole, as shown in FIGS. 4D to 4F. One rotor 24 of the rotor assembly 12 whose opposed ends are magnetized as the north magnetic pole is attracted by the sequential magnetization of the three pairs of the projection lines 14 of the stator core 16 with the S-magnetic pole, and is rotated, together with the rotor 22, through remaining another half turn in the counterclockwise direction in FIGS. 4D to 4F. As described above, the rotation speed of the two rotors 22 and 24 of the rotator assembly 12 is determined by frequency of the three-phase alternating current supplied to the three lead wires (not shown) for the exciting winding wires 18 (FIG. 1) of the stator core 16.

When the two rotors 22 and 24 of the rotator assembly 12 are rotated in the center hole of the stator core 16 in a predetermined direction (from left to right in FIG. 1), leading one of the opposite side surfaces 30 of each of the opposite ends of each of the two rotors 22 and 24 in the rotational direction of the rotor assembly functions as the blade for the axial-flow pump, and pushes the fluid located within the recess 28 spread along each of the opposite sidle surfaces 30 of each of the two rotors 22 and 24 between the opposite ends of each of the two rotors 22 and 24 in the stator core corresponding space region 23 in the center hole of the stator assembly 10, in a predetermined direction as shown by arrows of two-dotted chain lines in FIG. 1, and the flow direction of the pushed fluid is forcedly guided by the plurality of fluid guide vanes 36 of the fluid guide device 33 which faces the downstream side rotor 24 from in the rotation directions of the two rotors 22 and 24 toward the downstream direction along the rotation center shaft 21, and is discharged from the fluid guide tube 38.

A fluid in the upstream side fluid guide tube 37 is forcedly guided in the rotation direction of the two rotors 22 and 24 by the plurality of fluid guide vanes 36 of the fluid guide device 33 which faces the upstream side rotor 22, then is introduced into the recess 28 between the opposite ends of the upstream side rotor 22, and is discharged from the upstream side rotor 22, or is introduced into the recess 28 between the opposite ends of the downstream side rotor 24, and is discharged into the downstream side fluid guide tube 40 by the downstream side rotor 24, and is discharged therefrom.

The plurality of fluid guide vanes 36 of the fluid guide device 33 facing the upstream side rotor 22 increases the fluid suction efficiency of the opposite side surfaces 30 of the opposite ends of the upstream side rotor 22 functioning as the blades for the axial-flow pump, and the plurality of fluid guide vanes 36 of the fluid guide device 33 facing the downstream side rotor 24 increase the fluid discharging efficiency of the opposite side surfaces 30 of the opposite ends of the downstream side rotor 24 functioning as the blades for the axial-flow pump.

In the electric pump according to the first embodiment according to the present invention as constituted in the above-described manner, if the supply order of the electric current to the pair of projection lines 14 of the phase-I, the pair of projection lines 14 of the phase-II and the pair of projection lines 14 of the phase-III of the stator core 16 is reversed, the rotation direction of the rotor assembly 12 can be reversed. In this case, a fluid flowing direction in the center hole of the stator assembly 10 is reversed to that described above.

Modification of the First Embodiment

In the electric pump according to the first embodiment according to the present invention as described above with reference to FIGS. 1 to 4F, the opposite side surfaces 30 of each of the opposite ends of the rotor 24 which function as the blades for the axial-flow pump are not arranged to be continuous with the opposite side surfaces 30 of each of the opposite ends of the rotor 22 which function as the blades for the axial-flow pump.

Figure 5:
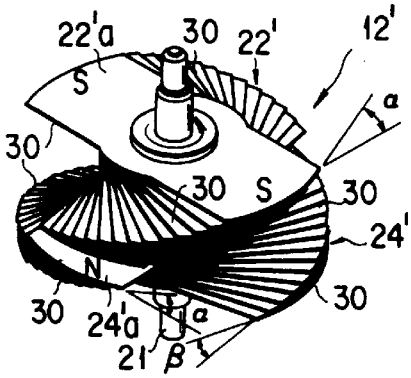
FIG. 5 is a schematic plan view of a rotor assembly according to a modification of the first embodiment.

From FIG. 5, in the two rotors 22' and 24' of the rotor assembly 12' according to a modification of the first embodiment, it can be seen that the opposite side surfaces 30 of each of the opposite ends of the rotor 24' which function as the blades for the axial-flow pump are arranged to be continuous with the opposite side surfaces 30 of each of the opposite ends of the rotor 22' which function as the blades for the axial-flow pump.

With this arrangement, in the modification of the first embodiment, the opposite side surfaces 30 of each of the opposite ends of the rotor 22' and the opposite side surfaces 30 of each of the opposite ends of the rotor 24' cooperate with each other to function the opposite side surfaces 30 of each of the opposite ends of the rotor 22' and the opposite side surfaces 30 of each of the opposite ends of the rotor 24' as opposite side surfaces of each of the opposite ends of one rotor. Therefore, a pump efficiency by the combination of the continuously arranged opposite side surfaces 30 of each of the opposite ends of each the two rotors 22' and 24' of the rotor assembly 12' is made greater than that by the combination of the non-continuously arranged opposite side surfaces 30 of each of the opposite ends of each of the two rotors 22 and 24 of the rotor assembly 12 of the above-described first embodiment.

In the rotor assembly 12' according to the modification of the first assembly and shown in FIG. 5, the same magnet as the circular shaped and axially magnetized magnet 26 of the above described first embodiment is interposed between the two rotors 22' and 24' on the center shaft 21, but the magnet can not be seen because it is concealed with the two rotors 22' and 24' in FIG. 5.

Also, in the rotor assembly 12' shown in FIG. 5, as in the case of the rotor assembly 12 of the above described first embodiment, the outer surface of each of the two rotors 22' and 24' and the outer surface of the magnet 26 (not shown in FIG. 5) may be covered integrally with a waterproof layer. In FIG. 5, since the waterproof layer is so thin that it is integral with these outer peripheral surfaces, the waterproof layer can not be seen. Such a waterproof layer may be constituted by adhering a synthetic resin of an organic material such as polyethylene or by adhering an inorganic material such as ceramic.

Depending on a thickness of the waterproof layer, small gaps produced on the side surfaces 30 of each of the opposite ends of each of the two rotors 22' and 24' by stacking and shifting of the plurality of core pieces 22'*a* or 24'*a* are buried under the layer so that the side surfaces 30 have smooth appearance.

Second Embodiment

An electric pump according to a second embodiment is different from that of the first embodiment described above with reference to FIGS. 1 to 4F in a structure of the rotor assembly.

Figure 6A:
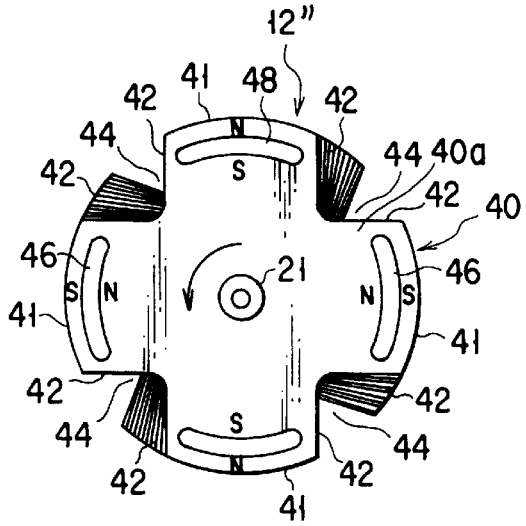
FIG. 6A is a schematic front view of a rotor assembly of an electric pump according to a second embodiment of the present invention.
Figure 6B:
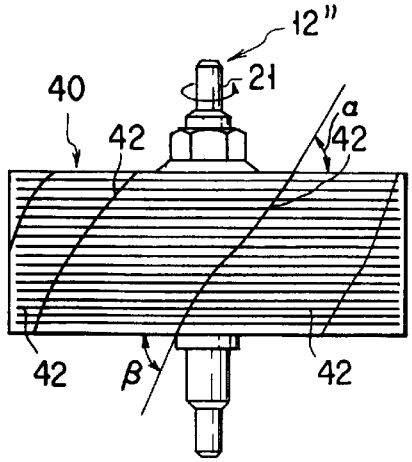
FIG. 6B is a schematic bottom view of the rotor assembly shown in FIG. 6A.

As shown in FIGS. 6A and 6B, a rotor 40 of the rotor assembly 12" of an electric pump according to the second embodiment has a substantially cross-shaped transverse section perpendicular to the center shaft 21. Circumferentially opposite side surfaces 42 of each of four projecting ends 41 of the cross-shaped rotor 40 are shaped to function as the blade for the axial-flow pump. That is, the rotor 40 defines four recesses 44 between the four projecting ends 41.

More specifically, the rotor 40 of the second embodiment is constituted by stacking a plurality of rotor pieces 40*a* in the direction along the center shaft 21, each rotor piece 40*a* having a substantially cross-shaped transverse section perpendicular to the center shaft 21, and by sequentially offsetting the rotor pieces 40*a* in the circumferential direction of the center shaft 21.

A magnet 46 in which the south magnetic pole is directed outward in the diametrical direction of the center shaft 21 is mounted to each of a pair of the projecting ends 41 located in the diametrical direction among the four projecting ends 41 of the rotor 40, and a magnet 48 in which the north magnetic pole is directed outward in the diametrical direction is mounted to each of the remaining pair of the projecting ends 41.

The rotor assembly 12" according to the second embodiment constituted in the above-described manner is combined with the stator assembly 10 of the electric pump according to the above-described first embodiment so that the rotor assembly 12" is rotated in a predetermined direction like the rotor assembly 12 according to the above-described first embodiment. While it is rotated, one side surface 42 among the opposite side surfaces 42 of each of the four projecting ends 41 of the rotor 40, said one side surface 42 being located at the leading side in the rotational direction of the rotor 40, discharges a fluid in each of the recesses 44 between the four projecting ends 41 of the rotor 40 in the center hole of the stator assembly 10, into either one of the two fluid guide tubes 37 and 38 adjacent the stator assembly 10 through the fluid guide vanes 36 of either one of the two fluid guide devices 33 in accordance with a rotational direction of the rotor 40, and sucks a fluid from the other fluid guide tube 37 or 38 through the fluid guide vanes 36 of the other fluid guide device 33.

Also, in the rotor assembly 12" shown in FIGS. 6A and 6B, as in the case of the rotor assembly 12 of the above described first embodiment, the outer surface of the rotor 40 with the magnets 46 and 48 is covered integrally with a waterproof layer. In FIGS. 6A and 6B, since the waterproof layer is so thin that it is integral with these outer peripheral surfaces, the waterproof layer can not be seen. Such a waterproof layer may be constituted by adhering a synthetic resin of an organic material such as polyethylene or by adhering a nonorganic material such as ceramic.

Depending on a thickness of the waterproof layer, small gaps produced on the side surfaces 42 of each of the four projecting ends of the rotor 40 by stacking and shifting of the plurality of core pieces 40'*a* are buried under the layer so that the side surfaces 42 have smooth appearance.

Third Embodiment

Figure 7:
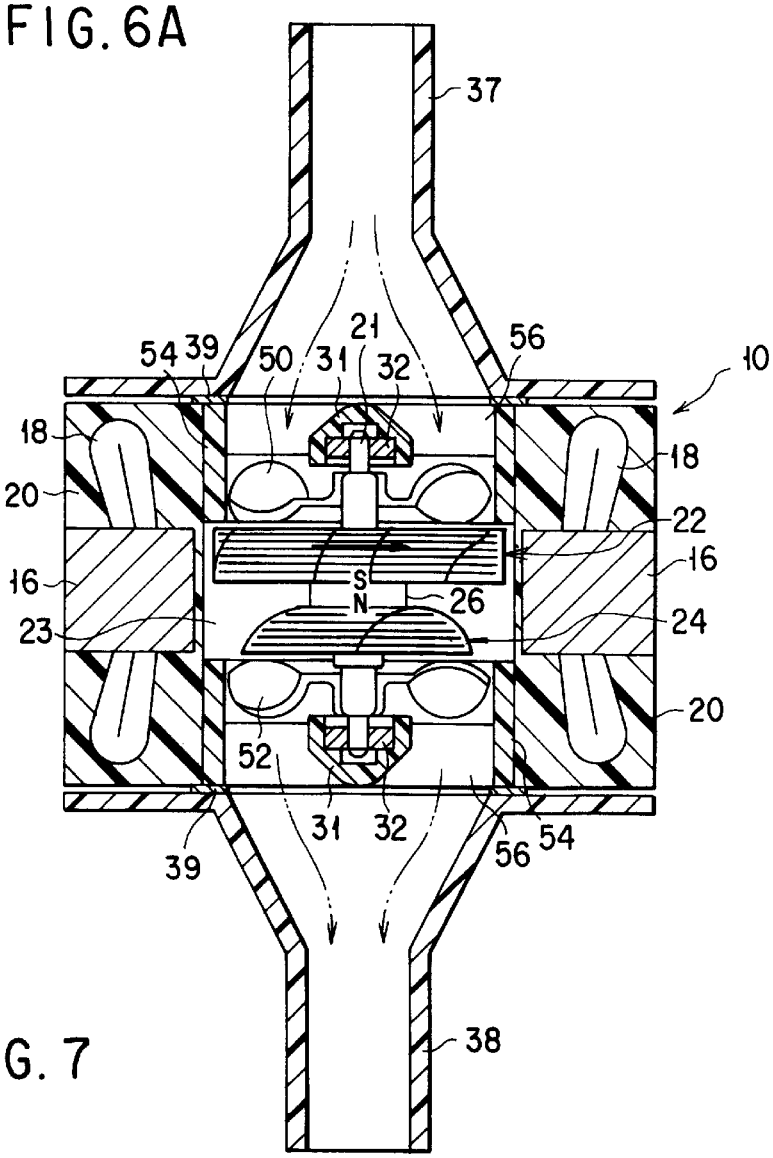
FIG. 7 is a schematic longitudinal sectional view of an electric pump according to a third embodiment of the present invention.

Next, referring to FIG. 7, an electric pump according to a third embodiment of the present invention will be described in detail. Since most portions of the structure of the electric pump according to the third embodiment are the same as those of the electric pump according to the first embodiment of the present invention as shown FIGS. 1 to 4F, structural elements of the present embodiment which are the same as those in the first embodiment shown in FIG. 1 are denoted by the same reference numerals in FIG. 7 as those used to denote the same structural elements in FIG. 1, and detailed descriptions thereof will be omitted.

The third embodiment is different from the first embodiment in that rotor blades 50 and 52 are disposed adjacent the two rotors 22 and 24 at opposite outsides of the stator core corresponding space region 23 in the center hole of the stator assembly 10 and are concentrically fixed on the center shaft 21 of the rotor assembly 12.

While the rotor assembly 12 is rotated in one direction, when the rotor 22 is located at the upstream side of the flow of the fluid in the center hole of the stator assembly 10 and the rotor 24 is located at the downstream side of the flow of the fluid in the center hole, the rotor blades 50 adjacent the rotor 22 function as fluid forcedly supplying rotor blades for forcedly supplying a fluid in the fluid guide tube 37 located in upstream of the rotor 22, to the rotor 22, and the rotor blades 52 adjacent the rotor 24 function as fluid forcedly discharging rotor blades for forcedly discharging a fluid immediately after it is discharged from the rotor 24 in the center hole, into the fluid guide tube 38 located in downstream of the rotor 24.

Reversely, while the rotor assembly 12 is rotated in the other direction, when the rotor 24 is located at the upstream side of the flow of the fluid in the center hole and the rotor 22 is located at the downstream side of the flow of the fluid in the center hole, the rotor blades 52 adjacent the rotor 24 function as the fluid forcedly supplying rotor blades for forcedly supplying a fluid in the fluid guide tube 38 located in upstream of the rotor 24, to the rotor 24, and the rotor blades 50 adjacent the rotor 22 function as the fluid forcedly discharging rotor blades for forcedly discharging a fluid immediately after it is discharged from the rotor 22 in the center hole, into the fluid guide tube 37 located in downstream of the rotor 22.

The rotor blades 50 and 52 increase the fluid suction efficiency and the fluid discharging efficiency of the opposite side surfaces of the opposite ends of each of the two rotors 22 and 24 of the rotor assembly 12 of the electric pump of the third embodiment, the opposite side surfaces of the opposite ends functioning as the blades for the axial-flow pump.

Each of the bearing supporting members 31 for the two bearings 32 supporting the opposite ends of the center shaft 21 of the rotor assembly 12 of the present embodiment is supported by inner ends of a plurality of supporting arms 56 extending radially inward from each of two cylindrical members 54 fitted in the inner peripheral surfaces of the inner hole of the stator assembly 10 at opposite outsides of the stator core corresponding space region 23. The plurality of supporting arms 56 can be formed such as to function as fluid guide vanes for the adjacent rotor blade 50 or 52. In this case, the supporting arms 56 increases the fluid forcedly supply function and the fluid forcedly discharge function of the adjacent two rotor blades 50 and 52.

In the first to third embodiments and the modification of the present invention described above with reference to FIGS. 1 to 7, each of the rotors 22, 24, 22' and 24' each having the substantially I-shaped transverse section is constituted by stacking the plurality of rotor pieces 22*a*, 24*a*, 22'*a* or 24'*a* each having the substantially I-shaped transverse section, in the direction along the center shaft 21 and by shifting the rotor pieces sequentially in the circumferential direction of the center shaft 21. However, each of the rotors 22, 24, 22' and 24'*a* may be formed as one block member, and the pair of rotors 22*a* and 24*a*, or 22'*a* and 24'*a* crossed at 90 degrees on the center shaft 21 may be formed as one block member. Further, the rotor 40 having the substantially cross shaped transverse section may be formed as one block, in place of being formed by stacking the plurality of the rotor pieces 40*a* each having the substantially cross shaped transverse section, in the direction along the center shaft 21 and by shifting the rotor pieces sequentially in the circumferential direction of the center shaft 21.

Fourth Embodiment

Next, referring to FIG. 8, an electric pump according to a fourth embodiment of the present invention will be described in detail.

Figure 8:
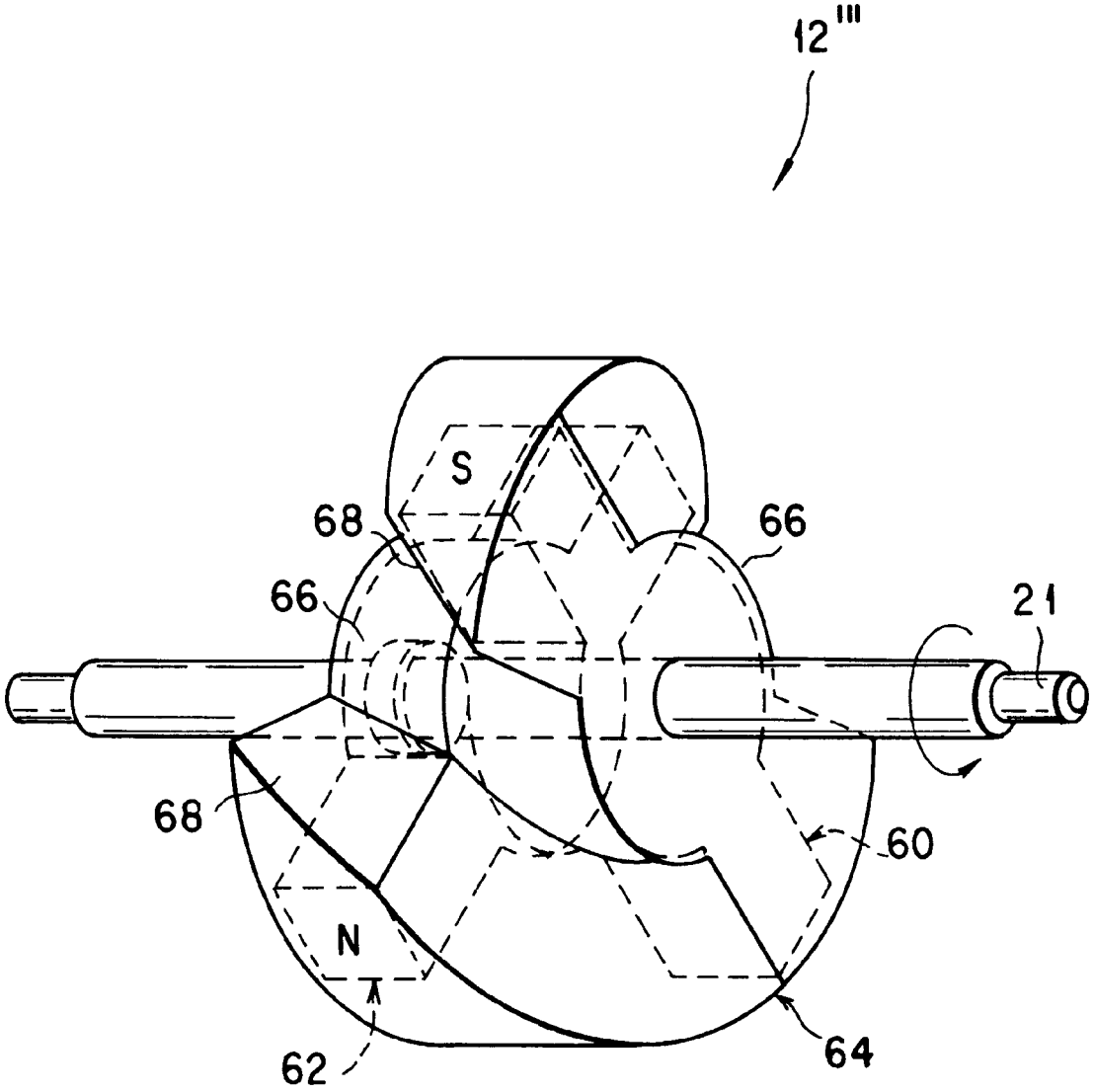
FIG. 8 in an enlarged schematic perspective view of a rotor assembly as a main portion of an electric pump according to a fourth embodiment of the present invention.

The electric pump according to the fourth embodiment is different from that of the first embodiment described above with reference to FIGS. 1 to 4F only in a structure of a rotor assembly 12''' shown in FIG. 8.

As shown in FIG. 8, the rotor assembly 12''' of the electric pump according to the fourth embodiment of the present invention comprises a pair of rotors 60 and 62 disposed on the center shaft 21 so that the rotors 60 and 62 are separated from each other in the longitudinal direction of the center shaft 21. Each of the rotors 60 and 62 has a substantially I-shaped transverse section perpendicular to the center shaft 21, and the two rotors 60 and 62 are crossed each other at 90 degrees on the center shaft 21.

In this embodiment, each of the pair of rotors 60 and 62 is formed as one block member, but it may be constituted only by stacking a plurality of rotor pieces each having an I-shaped transverse section perpendicular to the center shaft 21.

A substantially cylindrical magnet which is the same as the substantially cylindrical magnet 26 (see FIG. 1) of the above described first embodiment is arranged on the center shaft 21 between the pair of rotors 60 and 62. This magnet magnetizes the opposite ends of one rotor 60 with S-magnetic pole and the opposite ends of another rotor 62 with N-magnetic pole.

The pair of rotors 60 and 62 and the above described substantially cylindrical magnet which is not shown in FIG. 8 are covered with a waterproof layer 64 constituted by the synthetic resin such as polyethylene.

This embodiment is characterized in that the outer peripheral surface of the pair of rotors 60 and 62 is not shaped to function the rotor assembly 12''' as an axial-flow pump, but the outer peripheral surface of the waterproof layer 64 is shaped to function the rotor assembly 12''' as the axial-flow pump.

The outer peripheral surface of the waterproof layer 64 has a plurality of recesses 66 extending in the longitudinal direction of the center shaft 21 at a plurality of positions separated from each other in the circumferential direction of the center shaft 21, and both side surfaces 68 of each of the recesses 66 in the circumferential direction are shaped as the blades of the axial-flow pump.

Such a waterproof layer 64 is formed by an injection molding of a material of the waterproof layer 64 on the outer surfaces of the pair of rotors 60 and 62 and the substantially cylindrical shaped magnet not shown in FIG. 8.

The pair of rotors 60 and 62 may be replaced with a rotor having a substantially cross-shaped transverse section.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. An electric pump, comprising:

a stator assembly having an annular transverse section and a longitudinal center line, the longitudinal center line extending along a longitudinal direction of the stator assembly and passing through a center of a center hole of the stator assembly;

a housing sandwiching the stator assembly in the longitudinal direction, the housing having a passage communicating opposite ends of the center hole of the stator assembly with an outer side of the housing, and a bearing unit arranged in the passage; and a rotor assembly rotatably supported in the center hole of the stator assembly by the bearing unit, the rotor assembly being selectively rotatable in a desired direction in cooperation with the stator assembly, wherein:

at least a portion of an outer peripheral surface of the rotor assembly is formed into a shape of a blade for an impeller of an axial-flow pump to provide a fluid in the center hole of the stator assembly with a propelling force in the longitudinal direction;

the rotor assembly has opposite end surfaces;

a plurality of recesses are provided in the rotor assembly, the recesses having side surfaces extending between the opposite end surfaces; and the side surfaces of the plurality of recesses extend between the opposite end surfaces of the rotor assembly in a direction along a rotational center line of the rotor assembly at a plurality of positions separated from each other in a circumferential direction of the outer peripheral surface of the rotor assembly, so as to function as blades for the impeller of the axial-flow pump.

2. An electric pump according to claim 1, wherein:

the rotor assembly includes a rotor having a plurality of core pieces stacked along the rotational center line of the rotor assembly;

each of the plurality of core pieces has a plurality of recesses each recessed radially inwardly at a plurality of positions separated from each other in a circumferential direction on an outer edge of each core piece; and the side surfaces of the plurality of recesses of the plurality of core pieces function as said blades for the impeller of the axial-flow pump by offsetting the plurality of core pieces in the circumferential direction while the plurality of core pieces are stacked in the longitudinal direction.

3. An electric pump according to claim 1, wherein the rotor assembly includes a core member made of a magnetic material and having a plurality of projections, each of which projects outwardly in a radial direction of the rotor assembly, and a magnet magnetizing the projections of the core member in the radial direction.

4. An electric pump according to claim 1, wherein the rotor assembly includes a plurality of rotors separated from each other along a rotational center line of the rotor assembly, and at least a portion of an outer peripheral surface of each of the rotors is formed into a blade for the impeller of the axial-flow pump.

5. An electric pump according to claim 4, wherein:

each of the rotors has a plurality of core pieces stacked along the rotational center line of the rotor assembly;

each of the plurality of core pieces of said rotor assembly has a plurality of recesses each recessed radially inwardly at a plurality of positions separated from each other in a circumferential direction on an outer edge of each core piece, and the side surfaces of the plurality of recesses of the plurality of core pieces function as said blades for the impeller of the axial-flow pump by offsetting the plurality of core pieces in the circumferential direction while the plurality of core pieces are stacked in the longitudinal direction.

6. An electric pump according to claim 4, wherein the rotor assembly includes a magnet disposed between adjacent ones of the rotors and magnetized in a direction along the rotational center line of the rotor assembly.

7. An electric pump according to claim 1, wherein the rotor assembly includes a rotor having an I-shaped transverse section perpendicular to a rotational center line of the rotor assembly.

8. An electric pump according to claim 1, wherein the rotor assembly includes a rotor having a cross-shaped transverse section perpendicular to a rotational center line of the rotor assembly.

9. An electric pump according to claim 1, further comprising a fluid guide device which previously rotates the fluid in a rotational direction of the rotor assembly before the fluid is introduced into the rotor assembly.

10. An electric pump according to claim 1, further comprising a fluid guide device which guides the fluid immediately after the fluid is discharged from the rotor assembly, from a rotational direction of the rotor assembly to a rotational center line thereof.

11. An electric pump according to claim 1, further comprising a rotor blade which rotates with the rotor assembly and which forcedly supplies the fluid toward the rotor assembly before the fluid is introduced into the rotor assembly.

12. An electric pump according to claim 1, further comprising a rotor blade which rotates with the rotor assembly and which forcedly discharges the fluid immediately after the fluid is discharged from the rotor assembly.

13. An electric pump according to claim 1, further comprising a waterproof layer covering an outer peripheral surface of the stator assembly.

14. An electric pump according to claim 1, further comprising a waterproof layer covering the outer peripheral surface of the rotor assembly.

15. An electric pump according to claim 14, wherein the waterproof layer is formed into the shape of the blade for the impeller of the axial-flow pump.

* * * * *